US012674612B1

(12) United States Patent
Melkonian et al.

(10) Patent No.: US 12,674,612 B1
(45) Date of Patent: Jul. 7, 2026

(54) COUNTERTOP ICE MAKING DEVICE WITH AN INTEGRATED, REMOVABLE WATER TANK

(71) Applicant: Brio Water Technology, Inc., City of Industry, CA (US)

(72) Inventors: Arman Melkonian, Pasadena, CA (US); Mark Melkonian, Northridge, CA (US); Felix Fan, Pasadena, CA (US)

(73) Assignee: Brio Water Technology, Inc., City of Industry, CA (US)

( * ) Notice: Subject to any disclaimer, the term of this patent is extended or adjusted under 35 U.S.C. 154(b) by 0 days.

(21) Appl. No.: 19/431,966

(22) Filed: Dec. 23, 2025

(51) Int. Cl.
*F25C 1/25* (2018.01)

(52) U.S. Cl.
CPC ..... *F25C 1/25* (2018.01); *F25C 2400/14* (2013.01)

(58) Field of Classification Search
CPC ..... F25C 1/25; F25C 2400/14
USPC ..... 141/1
See application file for complete search history.

(56) References Cited

U.S. PATENT DOCUMENTS 3,357,200 A * 12/1967 Connors ..... F25C 1/04 62/353
4,255,942 A * 3/1981 Lanzani ..... F25C 1/045 62/347
2006/0112715 A1* 6/2006 Chung ..... F25C 1/25 62/340
2013/0312449 A1* 11/2013 Sundhar ..... F25D 31/007 62/344
2020/0240124 A1* 7/2020 Melson ..... F25D 21/14
2022/0018589 A1* 1/2022 Miller ..... B67D 1/0861
2025/0093085 A1* 3/2025 Winckler ..... F25C 1/147
2025/0296828 A1* 9/2025 Wantland ..... B67D 1/0081

* cited by examiner

*Primary Examiner* — Christopher M Afful
(74) *Attorney, Agent, or Firm* — Foundation Law LLP

(57) ABSTRACT

A countertop ice making device with a small countertop footprint that is easily refillable within the constraint of an overhead cabinet is disclosed. The ice making device includes an integrated, removeable water tank that can be removed laterally from underneath a cabinet. The icemaking device reduces the need for any extra external tubing and reduces the amount of potential extra leak points and is aesthetically pleasing.

20 Claims, 14 Drawing Sheets

COUNTERTOP ICE MAKING DEVICE WITH AN INTEGRATED, REMOVABLE WATER TANK

BACKGROUND

Stand-alone ice makers are popular consumer appliances. Users typically locate their stand-alone ice maker on a kitchen countertop under a kitchen cabinet, and the standard height between the top of the counter and the bottom of the cabinet is only eighteen inches (18"). This does not provide much room and presents significant constraints because kitchen countertop space is a premium. So, ideally, a stand-alone ice maker needs to have the smallest footprint possible. Also, being placed underneath a kitchen cabinet limits the vertical space above the ice maker, which makes fitting a pitcher above the ice maker near to impossible and removing anything from the icemaker upward difficult. Because of the overhead cabinet constraint, with many of the present ice makers, when the water needs to be refilled, it is difficult or cumbersome for the user to refill with a water pitcher since a water pitcher cannot fit above the ice maker when it is on the counter because of the cabinet-height limitation. With these devices, if they are required to be filled from the top, the user typically needs to move the ice maker from underneath the cabinet to make room for the pitcher or needs to move the ice maker over to a water source, such as a faucet. Since, for constant ice production in a stand-alone ice maker, the ice maker needs to be refilled frequently, both of these methods of refilling are not ideal and very inconvenient for the user.

Some ice makers try to address this issue by providing a front pull-out drawer for the user to use to refill the ice maker. With these devices, a user fills a pitcher, pulls out the drawer from the front of the ice maker and then fills the drawer with water from the pitcher. These arrangements are often unwieldy and messy, creating a situation where it is very easy for the user to spill water outside of the drawer, either on the countertop or the floor, which the user must then clean up. Other ice makers have tried to address the difficult refill problem by providing a water tank that is entirely separate from the ice maker and sits beside it. These devices, in their attempt to address the refill issue, end up taking up a lot of countertop space, which, as explained above, is not ideal because countertop space is a premium. These setups also require a lot of extra external tubing, creating extra potential leak points, and they tend not to be very aesthetically pleasing.

Accordingly, there is a need for a countertop ice making device with a small countertop footprint that is easily refillable within the constraint of an overhead cabinet.

SUMMARY

According to one aspect of the present invention, a countertop ice making device includes a housing with an ice maker and a valve actuator internal to the housing; and a removable water tank. The housing may further include a plurality of outer sidewalls, an interior sidewall offset from one of the outer sidewalls and a water tank receiving platform that extends from the interior sidewall towards the one outer sidewall. The interior sidewall and the one outer sidewall may define a water tank receiving space to receive the removable water tank. The interior sidewall may include at least one water tank first connector, and the water tank receiving platform may define a water valve receptacle that provides access to the valve actuator. The removable water tank may further include at least one water tank second connector and a water outlet valve.

When the water tank is connected to the housing, the at least one water tank first connector of the interior sidewall may engage the at least one water tank second connector of the water tank; the water tank may sit in the water tank receiving space on the water tank receiving platform and the water outlet valve may protrude through water valve receptacle and the valve actuator engages the water outlet valve; and to remove the water tank from the housing, the water tank may be elevated above the water tank receiving platform such that the at least one water tank second connector of the water tank disengages from the at least one water tank first connector of the interior sidewall and the water outlet valve is withdrawn from the water valve receptacle allowing the water tank to be removed laterally from the water tank receiving space of the housing.

According to one aspect of the present invention, a countertop ice making device includes a housing with an ice maker and a valve actuator internal to the housing; and a removable water tank. The housing may further include a plurality of outer sidewalls, an interior sidewall offset from one of the outer sidewalls and a water tank receiving platform that extends from the interior sidewall towards the one outer sidewall. The interior sidewall and the one outer sidewall may define a water tank receiving space to receive the removable water tank. The interior sidewall may have a plurality hook-shaped first connectors formed on it, where each hook-shaped first connector may define a groove. The water tank receiving platform may define a water valve receptacle that provides access to the valve actuator. The removable water tank may have a plurality of alignment grooves formed on it and formed at the end of each alignment groove may be a hook-shaped groove that forms a second connector. The removable water tank may further include a removable cover, a water outlet valve, a spacing wall and a plurality of engagement ribs formed integral with and extending inward from the spacing wall.

When the water tank is connected to the housing, the plurality of hook-shaped first connectors of the interior sidewall slide may be disposed in a corresponding alignment groove and may engage a corresponding hook-shaped second connector of the water tank; the water tank may sit in the water tank receiving space on the water tank receiving platform while the plurality of engagement ribs engage the water tank receiving platform and the spacing wall provides support to the water tank; and the water outlet valve protrudes through water valve receptacle and the valve actuator engages the water outlet valve; and to remove the water tank from the housing, the water tank may be elevated above the water tank receiving platform such that a plurality of hook-shaped second connectors of the water tank may disengage from each corresponding hook-shaped first connector of the interior sidewall and are slid out of a corresponding alignment groove; and the water outlet valve is withdrawn from the water valve receptacle allowing the water tank to be removed laterally from the water tank receiving space of the housing. Another aspect of the invention includes a method for refilling a countertop ice making device located on a countertop underneath a cabinet using a provided ice making device.

DRAWINGS

Objects, features, and advantages of the present invention will become apparent upon reading the following description in conjunction with the drawing figures, in which.

DESCRIPTION

Figure 1:
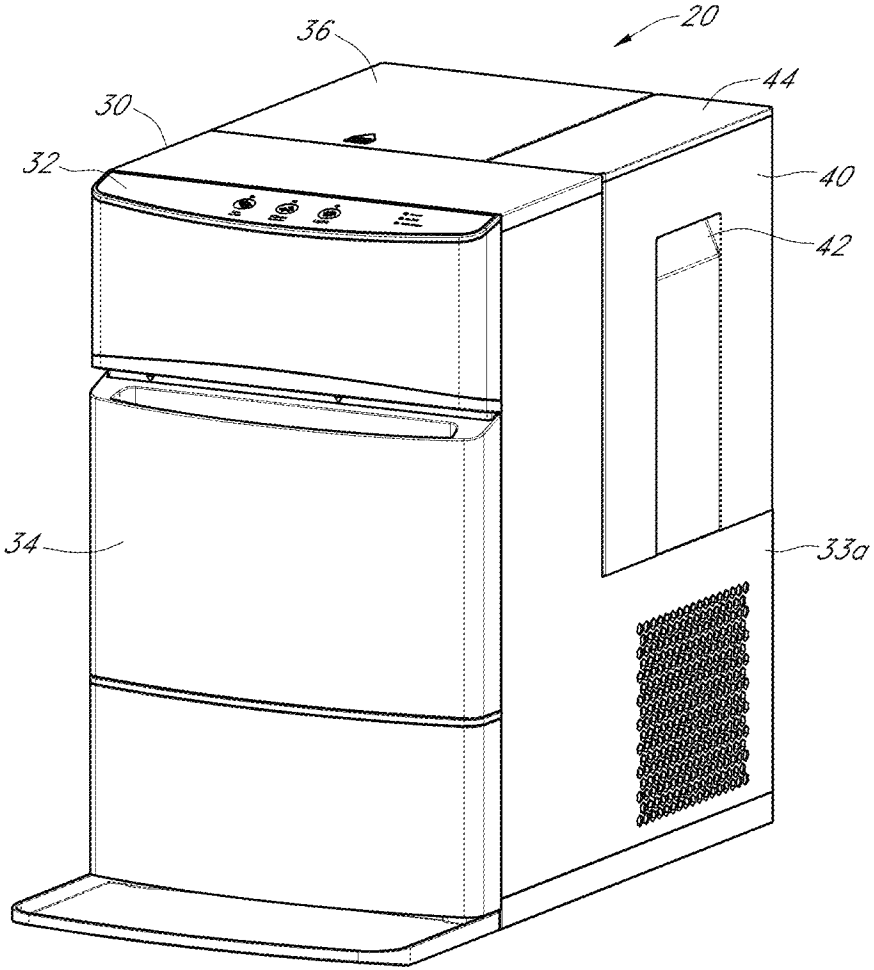
FIG. 1 is a front perspective view of an ice making device of the present invention with a water tank installed.
Figure 2:
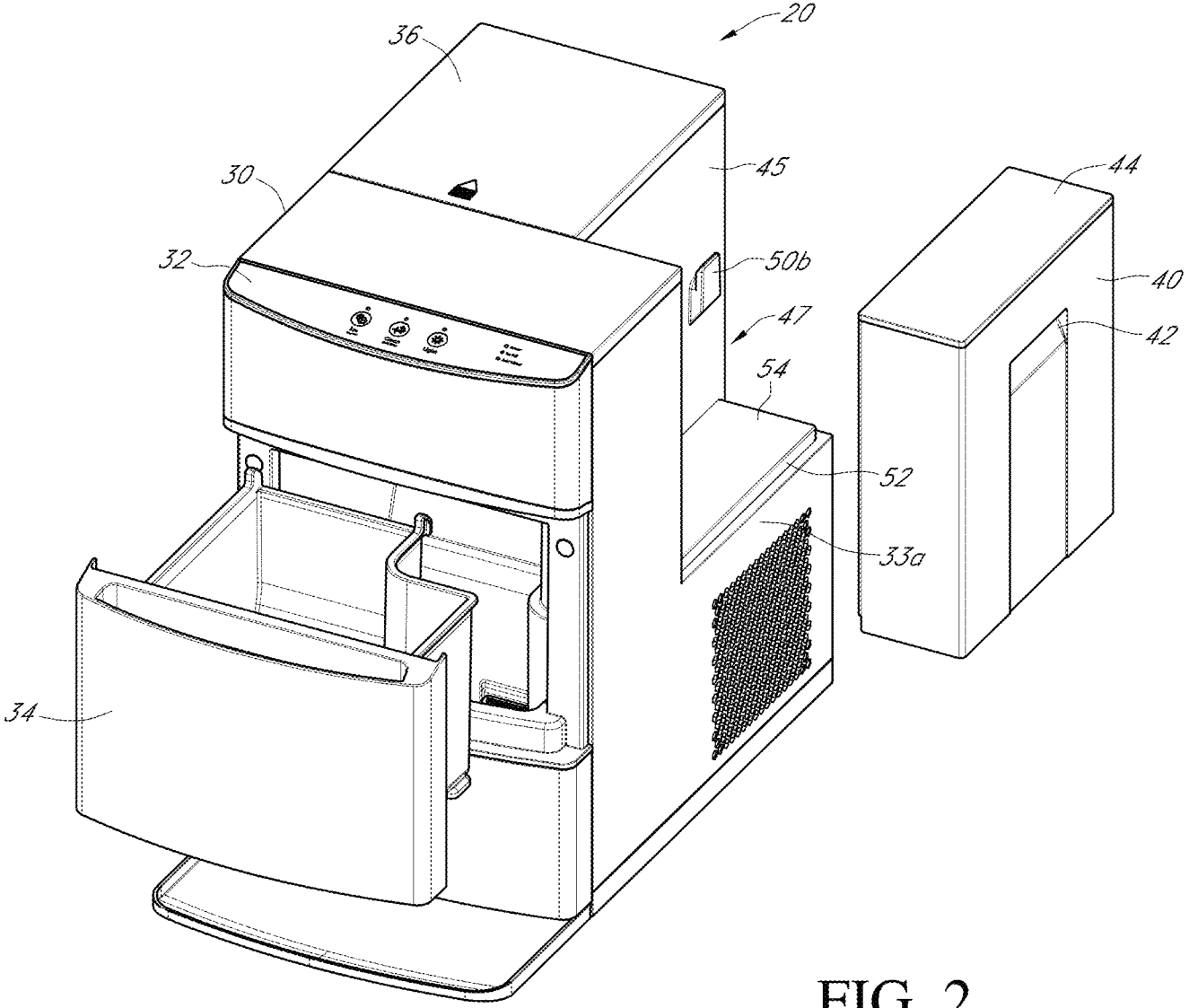
FIG. 2 is a front perspective view of the ice making device of the present invention with the drawer removed and the water tank removed.
Figure 3:
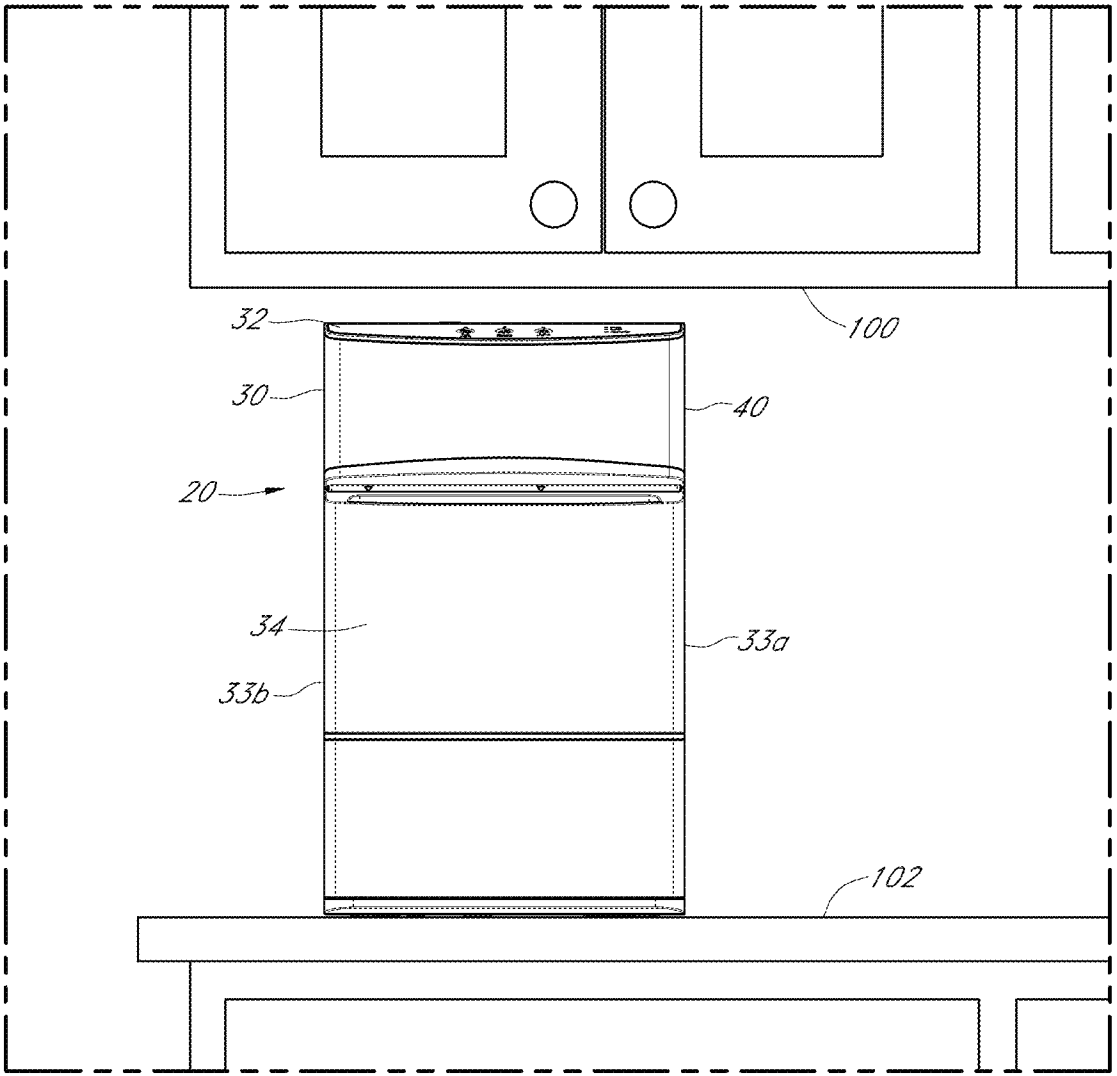
FIG. 3 is a front view of the ice making device of the present invention located on a countertop underneath a cabinet.

Referring to FIGS. 1-3, an embodiment of a countertop ice making device 20 of the present invention is depicted. The ice making device 20 includes a housing 30, an ice drawer 34 and an integrated, removable water tank 40. The housing 30 includes a user control panel 32, an interior access panel 36, outer sidewalls 33*a*, 33*b*, an interior sidewall 45, a set of water tank connectors 50*a*, 50*b* (FIG. 10) and a water tank receiving platform 54, which in one embodiment is approximately 0.5 inches in height. Internal to the housing 30 is an ice maker and ice making and dispensing components that make ice and dispense ice into the drawer 34 for removal and use by the user. These internal components are not depicted. When the water tank 40 is filled and connected to the housing 30, water from the water tank 40, as described in more detail below, flows into ice making components internal to the housing 30 to make ice. As illustrated in FIG. 3, the ice making device 20 is a stand-alone ice maker that typically sits on a countertop 102 and underneath a set of cabinets 100. As mentioned above, the standard height between the top of the counter and the bottom of the cabinet is only eighteen inches (18"). In such an environment, the user does not have much room to remove an integrated removable, refillable water tank because the height that a water tank can be lifted is constrained by the limited vertical clearance caused by the underside of the cabinets 100.

Figure 10:
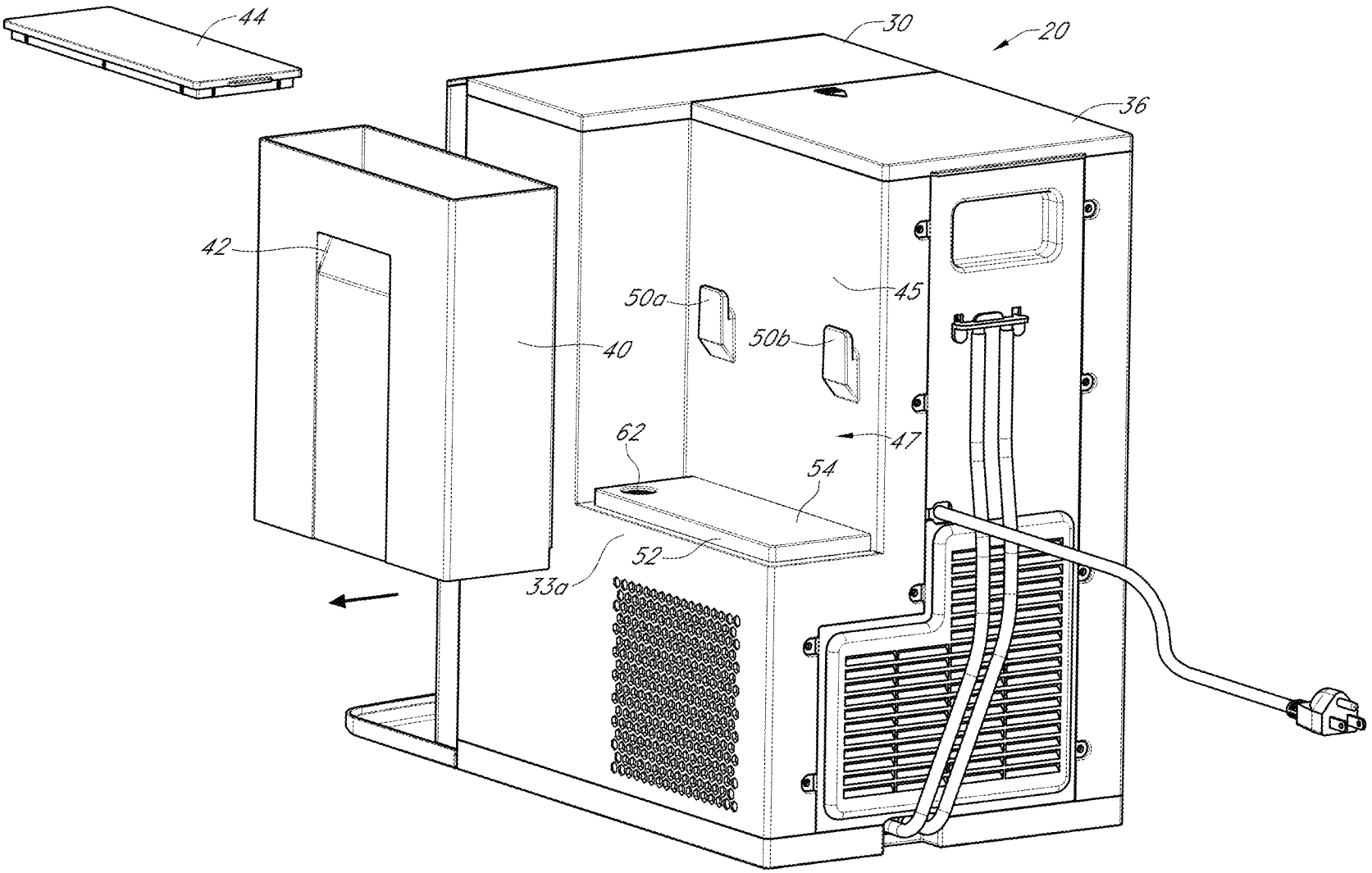
FIG. 10 is a rear perspective view of the ice making device of the present invention with the water tank removed and a cover removed from the water tank.
Figure 11:
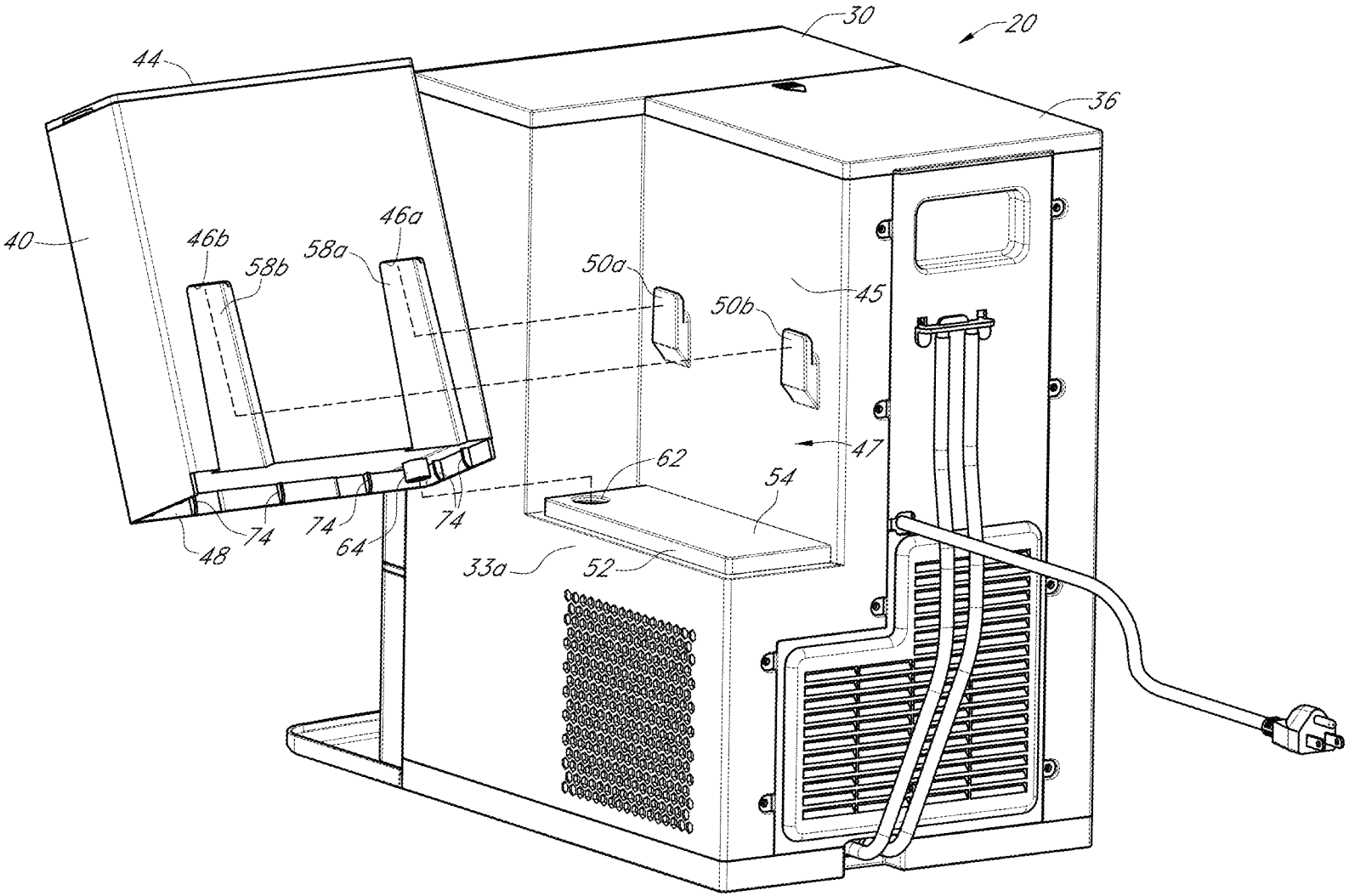
FIG. 11 is a rear perspective view of the ice making device of the present invention with the water tank removed and turned to illustrate alignment grooves and underside components of the water tank.

Referring now specially to FIGS. 2 and 10-11, in this embodiment, the interior sidewall 45 and the outer sidewall 33*a* define a water tank receiving space 47, and the water tank receiving platform 54 extends outward from the interior sidewall 45 towards the outer sidewall 33*a*. When the water tank 40 is connected to the housing 30, the water tank 40 sits in the water tank receiving space 47. The water tank receiving platform 54 includes a raised edge 52 and defines a water valve receptacle 62. In one embodiment to accommodate the integrated water tank 40, the drawer 34 is configured in an "L" shape.

Referring now specially to FIGS. 8-11, in this embodiment, within the housing outer sidewall 33*a* beneath the water tank receiving platform 54 and the water valve receptacle 62 are the ice maker water intake components 80, included with these components is a valve actuator 66. In this embodiment, the removable water tank 40 includes a handle 42 and a removable cover 44. As illustrated, the handle 42 may be formed into the water tank 40. Also, in this embodiment, alignment grooves 58*a*, 58*b* are formed in the water tank 40, and each alignment groove 58*a*, 58*b* is formed with a water tank connector 46*a*, 46*b* at the end of the groove 58*a*, 58*b*. As explained in more detail below, in this embodiment, the connectors 46*a*, 46*b* mate with the connectors 50*a*, 50*b* formed in the interior sidewall 45 to hold the water tank 40 in place in the water tank receiving space 47. The water tank 40 also includes a water outlet valve 72, which sits in the bottom of the water tank 40. In one embodiment, the bottom of the water tank 40 may be slanted towards the water outlet valve 72. The water outlet valve 72 acts to seal the water tank 40 when the water tank 40 is not on the receiving platform 54 and, when on the receiving platform 54, the water outlet valve 72 is moved to an open position, allowing water to flow through the water outlet valve 72. The water outlet valve 72 has a plug 60, a gasket seal 68 and a spring 70. The spring 70 surrounds the base of the plug 60 and is biased downward by the outside of the bottom of the water tank 40. The gasket seal 68 sits in a groove of the plug 60 and seals an indent formed on the inside surface of the bottom of the water tank 40 when the spring 70 is extended. A protective annular ring 64 is formed integral with the outside bottom of the tank 40 and acts to protect the components of the water outlet valve 72 that sit within the protective annular ring 64. Also, formed integrally along the bottom of the water tank 40 and extending outward therefrom is a spacing wall 48. The spacing wall 48, in this embodiment, has several engagement ribs 74 formed integral with the spacing wall 48 that extend inward from the spacing wall 48. When the water tank 40 is in place in the water tank receiving space 47, the spacing wall 48 engages the receiving platform 54 and supports the water tank 40, and the engagement ribs 74 engage the raised edge 52 of the receiving platform 54 to stabilize the water tank 40. Also, in addition to the protection that the protective annular ring 64 provides, the spacing wall 48 provides further protection to the water outlet valve 72 from getting bumped or cracked when the user is moving the water tank 40.

Figure 4:
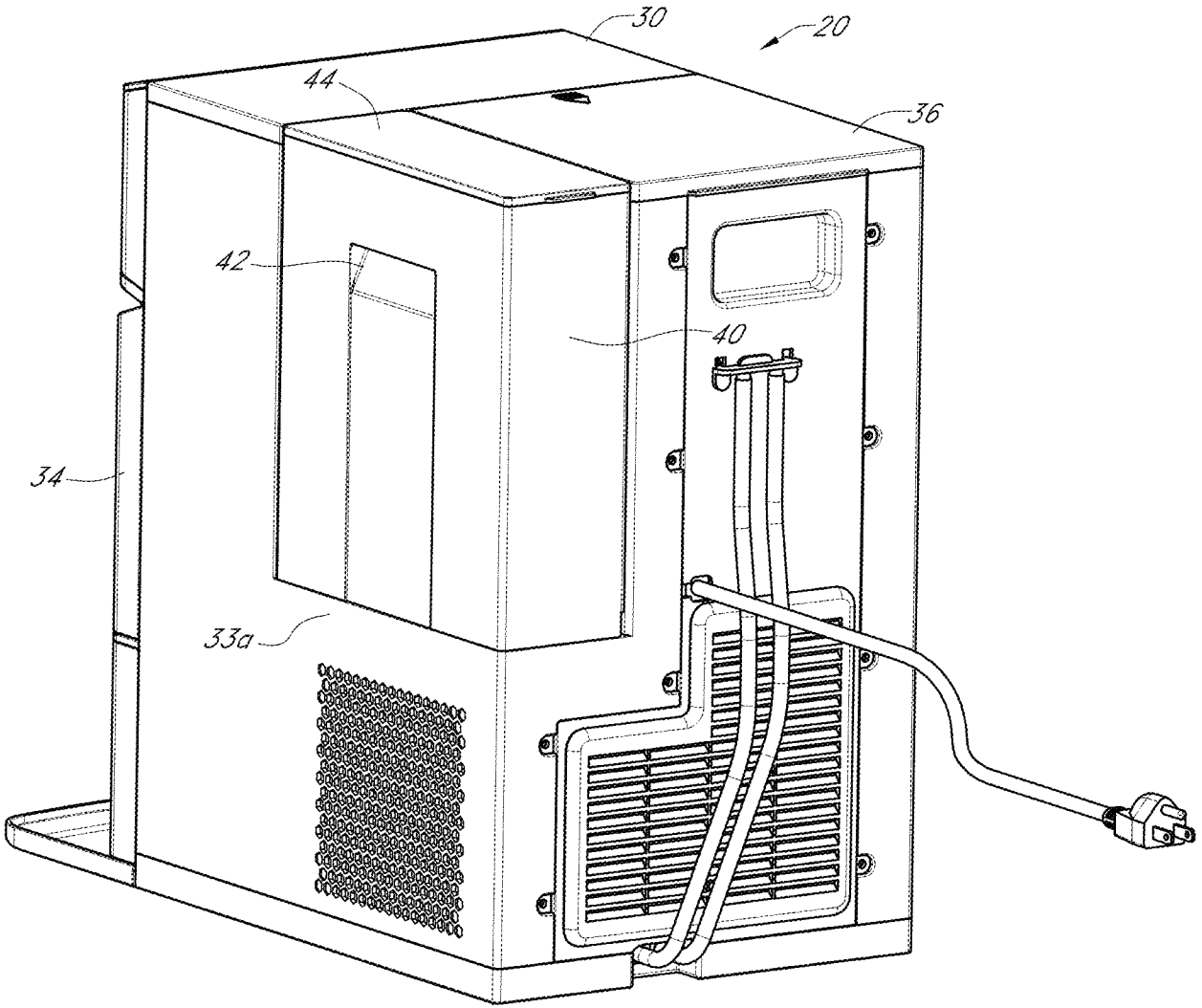
FIG. 4 is a rear perspective view of the ice making device of the present invention with the water tank installed.
Figure 5:
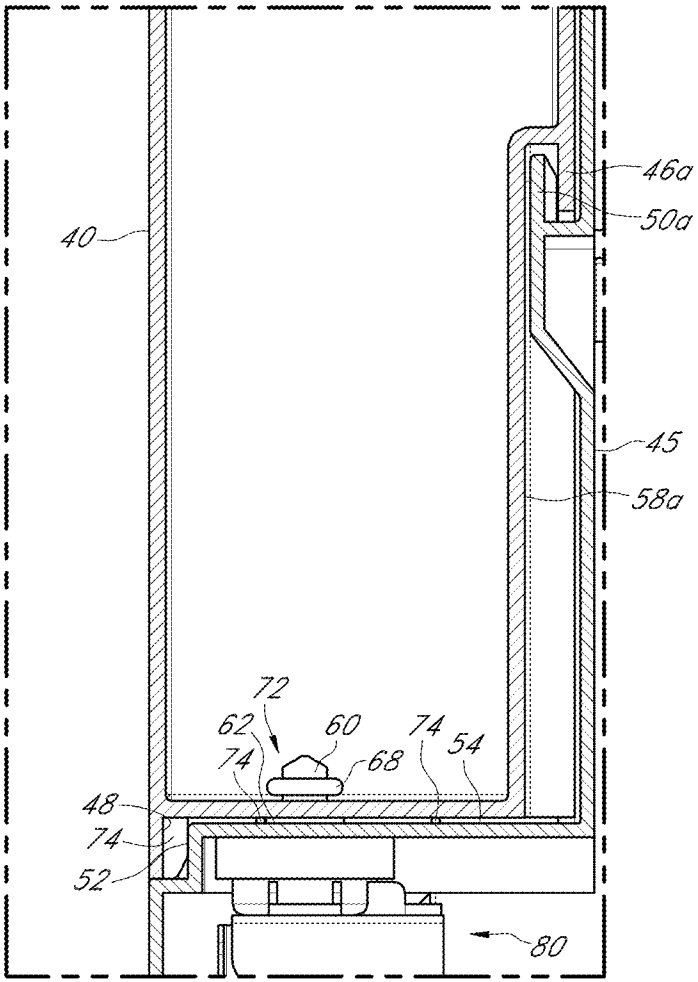
FIG. 5 is a partial sectional viewing depicting the water tank in place in a receiving space with the water tank connected to an interior sidewall.
Figure 6:
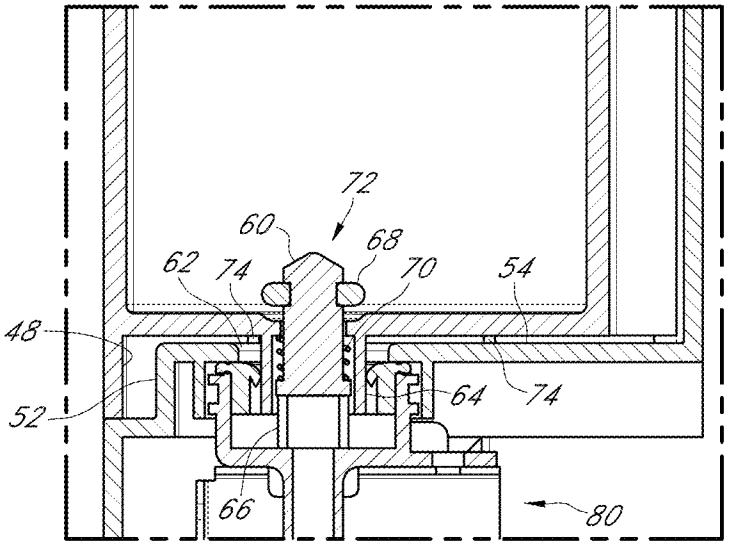
FIG. 6 is a partial sectional viewing depicting the water tank in place with a water outlet valve engaged with a valve actuator.
Figure 7:
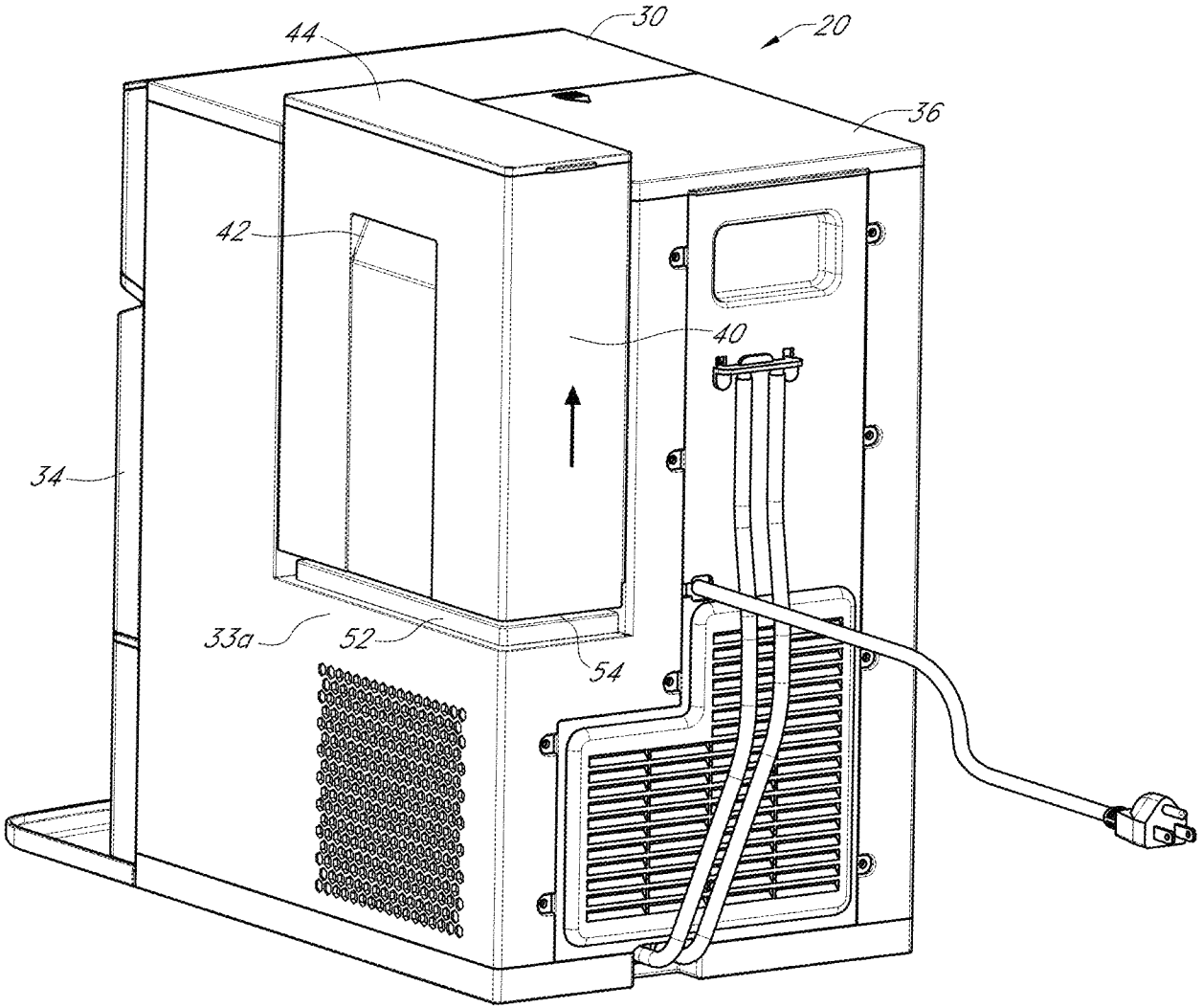
FIG. 7 is a rear perspective view of the ice making device of the present invention depicting the water tank being removed.
Figure 8:
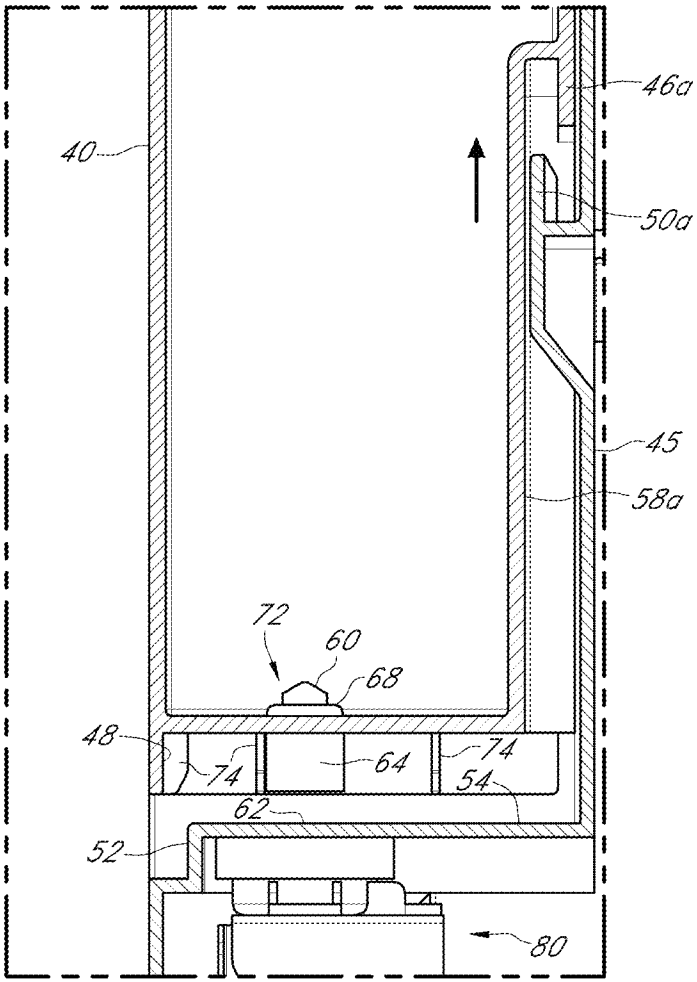
FIG. 8 is a partial sectional viewing depicting the water tank being removed from the receiving space with the water tank being disconnected from the interior sidewall.
Figure 9:
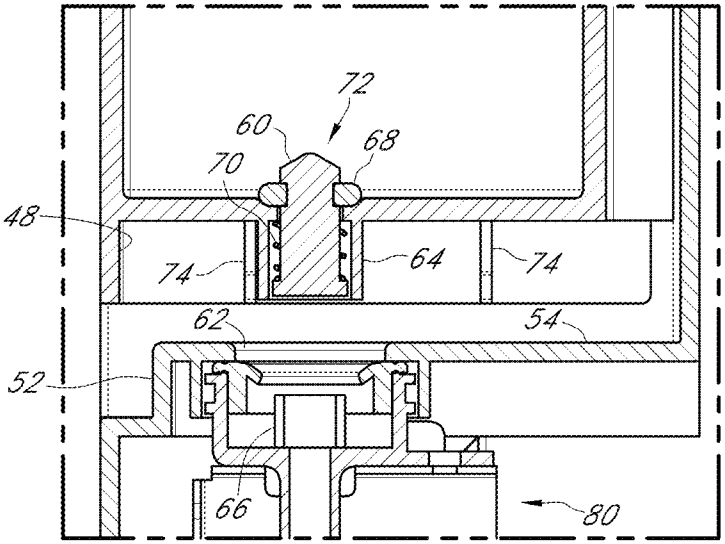
FIG. 9 is a partial sectional viewing depicting the water tank being removed with the water outlet valve being disengaged from the valve actuator.

Referring now to FIGS. 4-14, the operation of the integrated, removable water tank 40 is described. Referring first specifically to FIGS. 4-6, the water tank 40 is depicted in place in the ice making device 20. The water tank 40 sits in the water tank receiving space 47. In this embodiment, the outside wall of the water tank 40 is flush with the outer sidewall 33*a* of the housing 30. This feature, in this embodiment, assists in making this configuration of the ice making device 20 of the present invention more aesthetically pleasing to the user. As depicted in FIG. 6, in this configuration, the spacing wall 48 is resting on the water tank receiving platform 54, the engagement ribs 74 are engaged with the raised edge 52 of the receiving platform 54 and the water outlet valve 72 is disposed within the water valve receptacle 62 and engaged with the valve actuator 66, compressing the spring 70 causing the gasket seal 68 to disengage from the indent in the bottom of the water tank 40. In the example illustrated in FIGS. 4-11, there is no water in the water tank 40. In the embodiment depicted, a user knows the water level of the water tank 40 because the water tank 40 is formed from translucent plastic, and the user can see the water level in the water tank 40. This design provides the user with a visual indicator of how full the water tank 40 is at any given moment. The embodiment described provides an advantage over prior devices where water is poured into an internal drawer or tank, and the user cannot see how full the water tank is. In other embodiments, the transparency or translucence of the water tank 40 may varied as needed.

Further, in this configuration, the connectors 46*a*, 46*b* formed in the water tank 40 are engaged with the tank connectors 50*a*, 50*b* formed integral with, and extending out from, the interior sidewall 45. In this embodiment, the connectors 46*a*, 46*b* and the connectors 50*a*, 50*b* form an interference fit with one another, securing and stabilizing the water tank 40 in the water tank receiving space 47. It should be understood that the depicted mating connectors 46*a*, 46*b*, 50*a*, 50*b* are only one embodiment of connectors that may be used to secure the water tank 40 in the water tank receiving space 47. Other types of mating connections may be used to secure the water tank 40 in place in the water tank receiving space 47 while, at the same time, only requiring limited vertical displacement to disengage the connectors so that the water tank 40 can be removed laterally, which allows the water tank 40 to be removed from underneath a cabinet 100.

Referring now to FIGS. 7-11, the water tank 40 is empty, and the user wants to refill the water tank 40. The user lifts the water tank 40 upward, as indicated by the arrows in FIGS. 7-8. By lifting the water tank 40 upward, the connectors 46*a*, 46*b* are disengaged from the connectors 50*a*, 50*b*. At the same time, the spacing wall 48 disengages from the water tank receiving platform 54; the engagement ribs 74 disengage from the raised edge 52 of the receiving platform 54 and the water outlet valve 72 disengages from the valve actuator 66 and is removed upward from the water valve receptacle 62. With the valve actuator 66 disengaged, the spring 70 is no longer compressed and goes to its resting state, which causes the gasket seal 68 to re-engage with the indent in the bottom of the water tank 40 and seal the water tank 40. Once connectors 46*a*, 46*b* are clear of the lips of connectors 50*a*, 50*b*, the user, as depicted in FIG. 10, can laterally remove the water tank 40. At this point, the user can remove the cover 44 and fill the water tank 40 with water.

Figure 12:
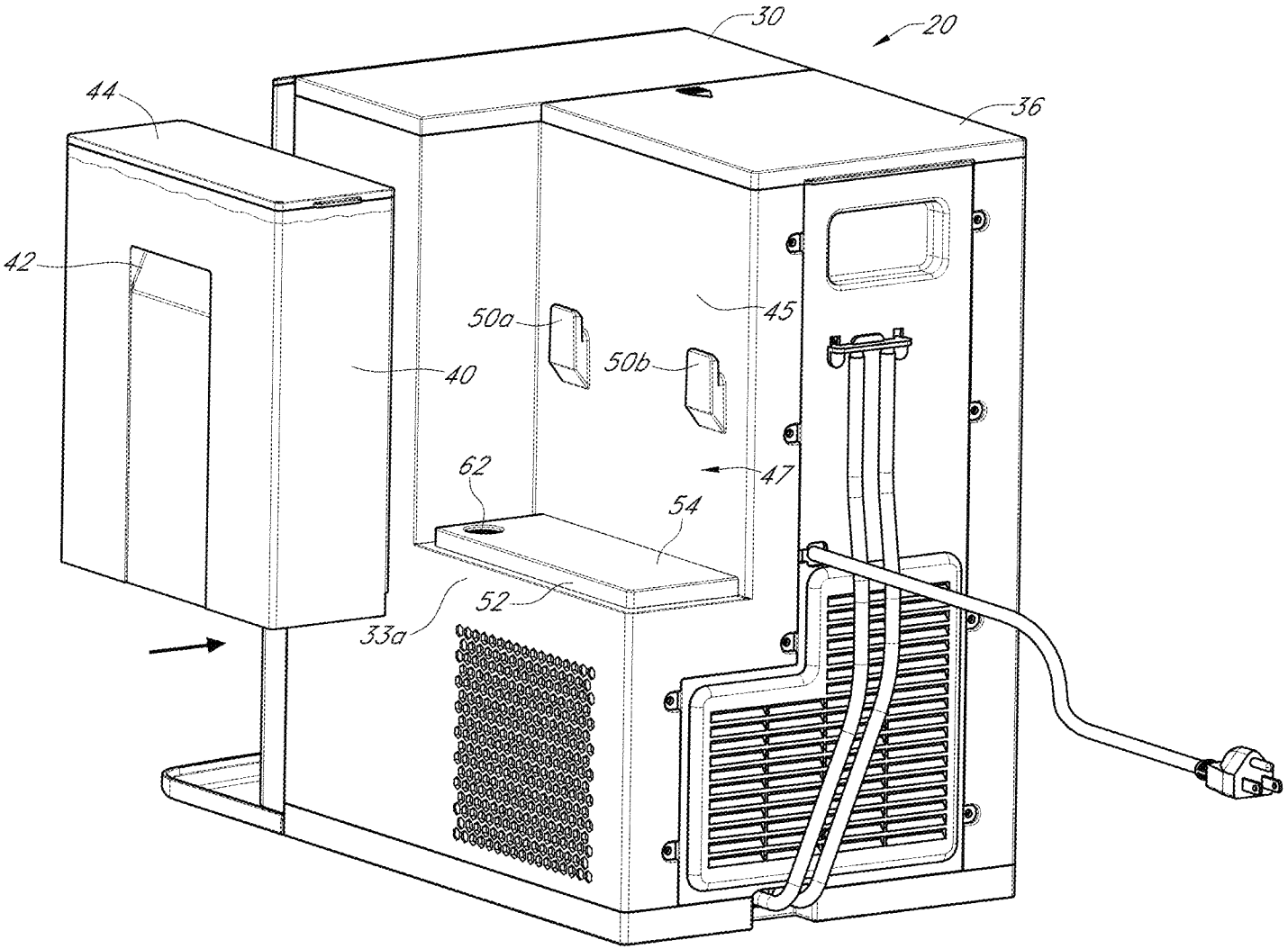
FIG. 12 is a rear perspective view of the ice making device of the present invention with the water tank filled and being moved into place in the water tank receiving space.
Figure 13:
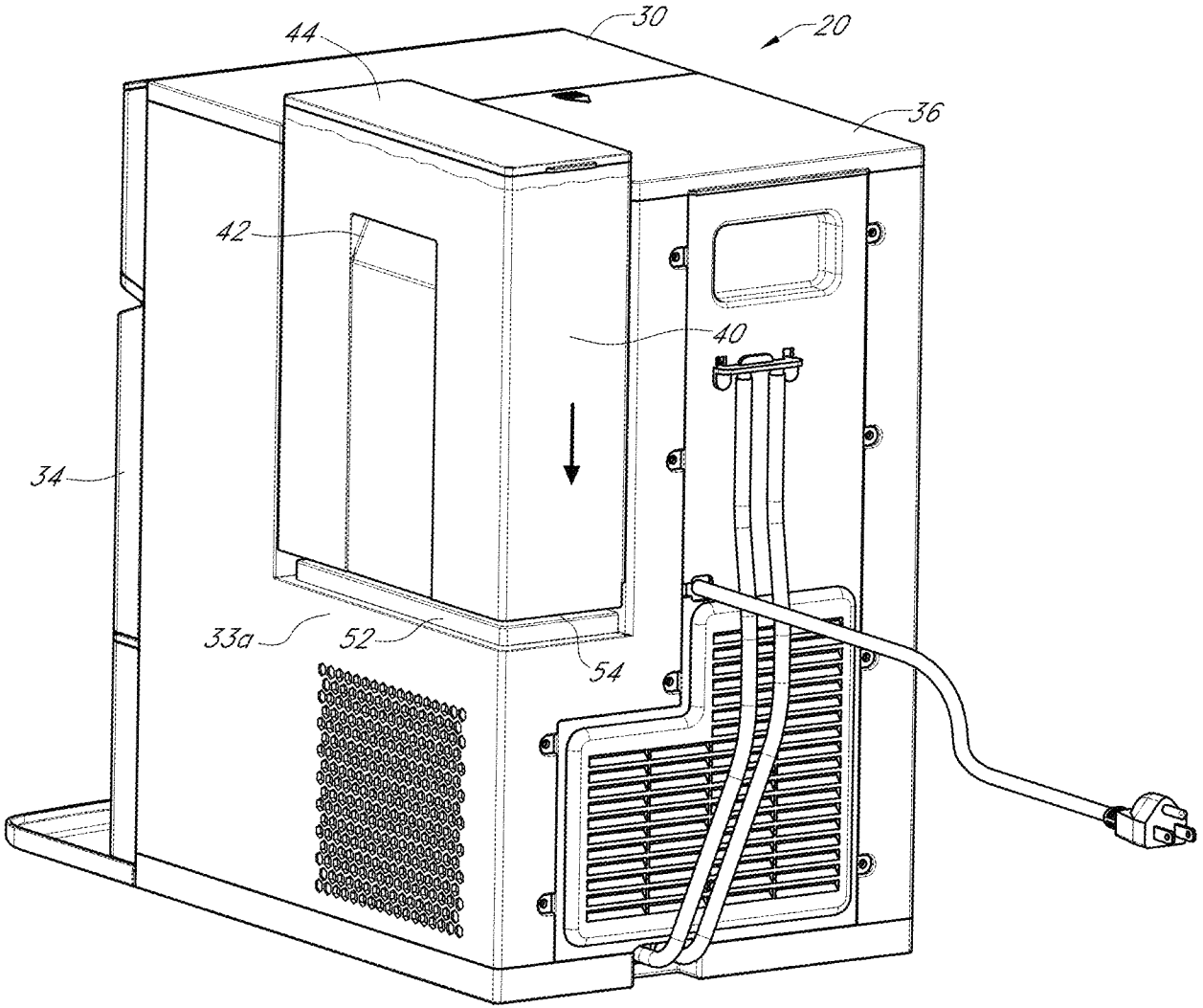
FIG. 13 is a rear perspective view of the ice making device of the present invention with the water tank filled and the water tank being moved downward to engage a receiving platform.
Figure 14:
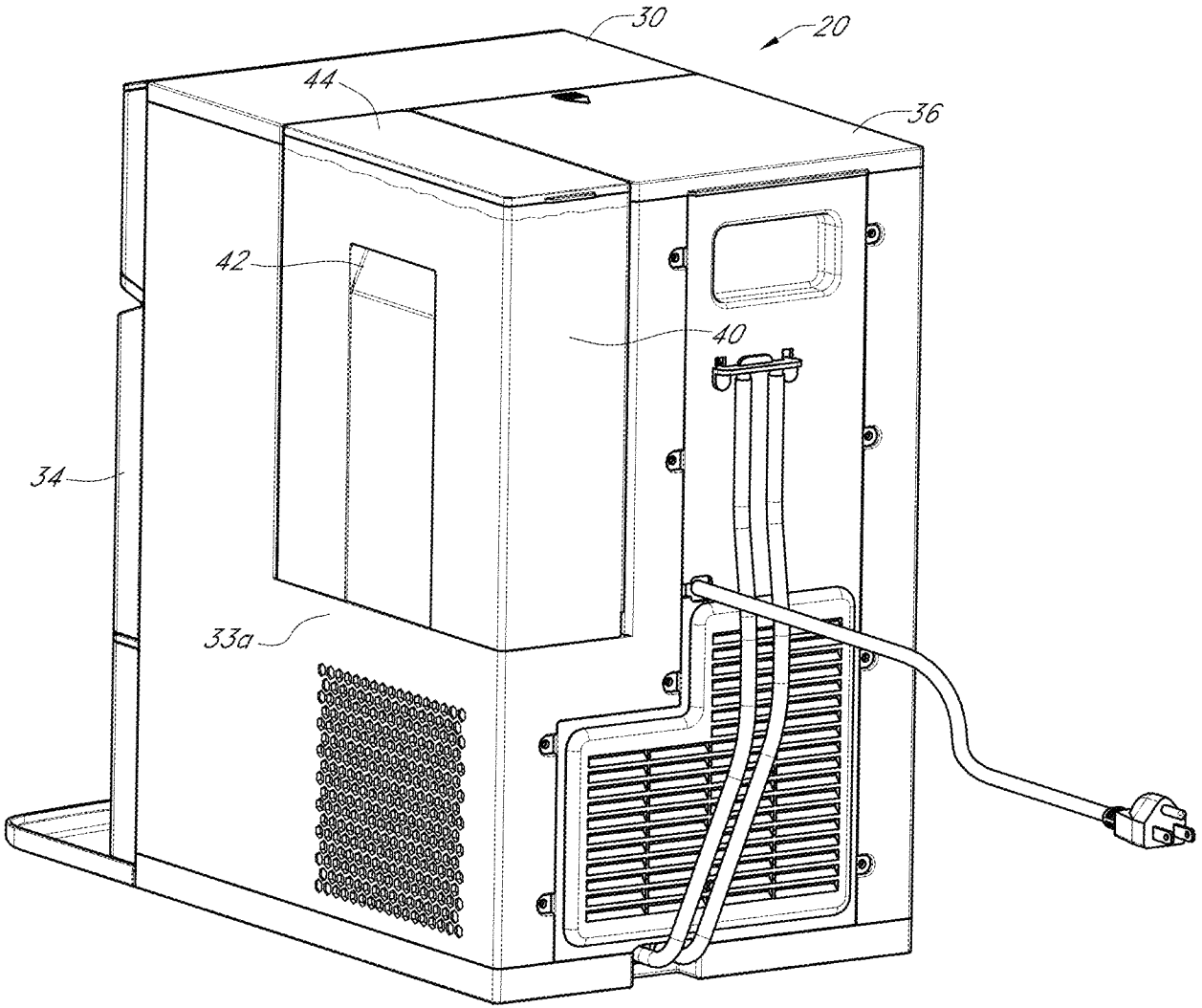
FIG. 14 is a rear perspective view of the ice making device of the present invention with the water tank filled and the water tank in place to be used to make ice.

Referring now to FIGS. 12-14, with the water tank 40 now filled, the user can easily put the water tank 40 back in place in the water tank receiving space 47 of the ice making device 20. As illustrated in FIG. 12, the user, by grasping and using the handle 42, moves the water tank 40 laterally, low enough to go underneath any cabinet 100 above the water tank 40, but high enough to clear the receiving platform 54. Once the water tank 40 is at the interior sidewall 45, the user aligns and inserts the connectors 50*a*, 50*b* into the alignment grooves 58*a*, 58*b*. In this embodiment, the alignment grooves 58*a*, 58*b* are wide enough and forgiving enough that the user can insert the connectors 50*a*, 50*b* into the alignment grooves 58*a*, 58*b* without having to actually visually align the connectors 50*a*, 50*b* with the alignment grooves 58*a*, 58*b*. As illustrated in FIG. 13, once the connectors 50*a*, 50*b* are in the alignment grooves 58*a*, 58*b*, the user moves the water tank 40 downward. The alignment grooves 58*a*, 58*b* not only serve the purpose of aligning the connectors 50*a*, 50*b* with the mating connectors 46*a*, 46*b*, but also, the important purpose of automatically aligning the water outlet valve 72 with the water valve receptacle 62 in the receiving platform 54 so the user does not have to figure out where the water valve receptable 62 is to try to blindly align the water outlet valve 72 with the water valve receptacle 62.

As the user continues to move the water tank 40 downward, similar to what is illustrated in FIGS. 5-6, the protective annular ring 64 and the water outlet valve 72 enter the water valve receptacle 62 until, eventually, the valve actuator 66 actuator engages the plug 60, compressing the spring 70, causing the gasket seal 68 to disengage from the indent in the bottom of the water tank 40. With the gasket seal 68 open, water flows from the water tank 40 into the ice maker water intake components 80 which connect to the internal components of the ice making device 20 to make ice. In this embodiment, the weight of the water tank 40 and the durometer of the gasket seal 68 are optimized to maximize the best seal and engagement release when the water tank 40 is connected to and removed from the receiving platform 54. Concurrent with the water outlet valve 72 entering the water valve receptacle 62, the engagement ribs 74 engage the raised edge 52 of the receiving platform 54. As depicted in FIG. 14, the water tank 40 is moved downward until the spacing wall 48 rests on the water tank receiving platform 54; the water outlet valve 72 is fully engaged with the valve actuator 66 and the interior sidewall connectors 50*a*, 50*b* are fully engaged with the tank connectors 46*a*, 46*b*, securing the water tank 40 in place. The ice making device 20 is now ready for operation.

Although certain embodiments and features of a countertop icemaking device with an integrated, removable water tank have been described herein, the scope of coverage of this patent is not limited thereto. On the contrary, this patent covers all embodiments of the teachings of the disclosure that fairly fall within the scope of permissible equivalents.

What is claimed is:

1. A countertop ice making device, comprising:

a housing with an ice maker and a valve actuator internal to the housing; and a removable water tank;

wherein the housing further comprises a plurality of outer sidewalls, an interior sidewall offset from one of the outer sidewalls and a water tank receiving platform that extends from the interior sidewall towards the one outer sidewall;

wherein the interior sidewall and the one outer sidewall define a water tank receiving space to receive the removable water tank;

wherein the interior sidewall includes at least one water tank first connector;

wherein the water tank receiving platform defines a water valve receptacle that provides access to the valve actuator;

wherein the removable water tank further comprises at least one water tank second connector and a water outlet valve;

wherein, when the water tank is connected to the housing, the at least one water tank first connector of the interior sidewall engages the at least one water tank second connector of the water tank; the water tank sits in the water tank receiving space on the water tank receiving platform and the water outlet valve protrudes through water valve receptacle and the valve actuator engages the water outlet valve; and wherein, to remove the water tank from the housing, the water tank is elevated above the water tank receiving platform such that the at least one water tank second connector of the water tank disengages from the at least one water tank first connector of the interior sidewall and the water outlet valve is withdrawn from the water valve receptacle allowing the water tank to be removed laterally from the water tank receiving space of the housing.

2. The countertop ice making device of claim 1, wherein:

the at least one water tank first connector of the interior sidewall is a plurality of water tank first connectors formed integral with the interior sidewall; and the at least one water tank second connector of the removable water tank is a plurality of water tank second connectors formed integral with the removable water tank.

3. The countertop ice making device of claim 2, wherein:

the plurality of water tank first connectors formed integral with the interior sidewall are hook-shaped with grooves;

the plurality of water tank second connectors formed integral with the removable water tank are hook-shaped with grooves; and to connect the removable water tank to the housing, the hook-shaped grooves of the removable water tank second connectors are engaged with the hook-shaped grooves of the interior sidewall.

4. The countertop ice making device of claim 3, wherein the removable water tank defines a plurality of alignment grooves formed therein and the plurality of hook-shaped grooves formed integral with the removable water tank are formed at the ends of the alignment grooves.

5. The countertop ice making device of claim 3, wherein for each hook-shaped groove formed on the interior sidewall, there is a corresponding alignment groove formed in the removeable water tank, having a hook-shaped groove formed at the end of each alignment groove, and wherein, when each hook-shaped groove on the interior sidewall is inserted into a corresponding alignment groove of the removable water tank, the alignment groove guides each hook-shaped groove of the interior sidewall until each such groove engages with a corresponding hook-shaped groove formed at the end of the alignment groove to secure the removable water tank to the housing.

6. The countertop ice making device of claim 5, wherein the engagement between each hook-shaped groove formed on the interior sidewall and the corresponding hook-shaped groove formed at the end of the alignment groove is an interference engagement.

7. The countertop ice making device of claim 1, wherein the water outlet valve comprises a plug, a gasket seal and a spring.

8. The countertop ice making device of claim 1, wherein the removeable water tank includes a protective annular ring that is disposed around the water outlet valve.

9. The countertop ice making device of claim 1, further comprises an L-shaped drawer.

10. The countertop ice making device of claim 1, wherein the removeable water tank is translucent.

11. The countertop ice making device of claim 1, wherein the removeable water tank is transparent.

12. The countertop ice making device of claim 1, wherein the removeable water tank further comprises a spacing wall and a plurality of engagement ribs formed integral with and extending inward from the spacing wall; wherein when the water tank sits in the water tank receiving space on the water tank receiving platform, the plurality of engagement ribs engage the water tank receiving platform and the spacing wall provides support to the water tank.

13. A countertop ice making device, comprising:

a housing with an ice maker and a valve actuator internal to the housing; and a removable water tank;

wherein the housing further comprises a plurality of outer sidewalls, an interior sidewall offset from one of the outer sidewalls and a water tank receiving platform that extends from the interior sidewall towards the one outer sidewall;

wherein the interior sidewall and the one outer sidewall define a water tank receiving space to receive the removable water tank;

wherein the interior sidewall has a plurality hook-shaped first connectors formed thereon, wherein each hook-shaped first connector defines a groove;

wherein the water tank receiving platform defines a water valve receptacle that provides access to the valve actuator;

wherein the removable water tank has a plurality of alignment grooves formed therein and formed at the end of each alignment groove is a hook-shaped groove that forms a second connector;

wherein the removable water tank further comprises a removable cover, a water outlet valve, a spacing wall and a plurality of engagement ribs formed integral with and extending inward from the spacing wall;

wherein, when the water tank is connected to the housing, the plurality of hook-shaped first connectors of the interior sidewall slide are disposed in a corresponding alignment groove and engage a corresponding hook-shaped second connector of the water tank; the water tank sits in the water tank receiving space on the water tank receiving platform while the plurality of engagement ribs engage the water tank receiving platform and the spacing wall provides support to the water tank; and the water outlet valve protrudes through water valve receptacle and the valve actuator engages the water outlet valve; and wherein, to remove the water tank from the housing, the water tank is elevated above the water tank receiving platform such that plurality of hook-shaped second connectors of the water tank disengage from each corresponding hook-shaped first connector of the interior sidewall and are slid out of a corresponding alignment groove; and the water outlet valve is withdrawn from the water valve receptacle allowing the water tank to be removed laterally from the water tank receiving space of the housing.

14. The countertop ice making device of claim 13, wherein the removeable water tank includes a protective annular ring that is disposed around the water outlet valve.

15. The countertop ice making device of claim 13, further comprises an L-shaped drawer.

16. The countertop ice making device of claim 13, wherein the removeable water tank is translucent.

17. A method for refilling a countertop ice making device located on a countertop underneath a cabinet, comprising:

providing an ice making device which comprises:

a housing with an ice maker and a valve actuator internal to the housing; and a removable water tank;

wherein the housing further comprises a plurality of outer sidewalls, an interior sidewall offset from one of the outer sidewalls and a water tank receiving platform that extends from the interior sidewall towards the one outer sidewall;

wherein the interior sidewall and the one outer sidewall define a water tank receiving space to receive the removable water tank;

wherein the interior sidewall has a plurality hook-shaped first connectors formed thereon, wherein each hook-shaped first connector defines a groove;

wherein the water tank receiving platform defines a water valve receptacle that provides access to the valve actuator;

wherein the removable water tank has a plurality of alignment grooves formed therein and formed at the end of each alignment groove is a hook-shaped groove that forms a second connector;

wherein the removable water tank further comprises a removable cover, a water outlet valve, a spacing wall and a plurality of engagement ribs formed integral with and extending inward from the spacing wall;

removing the water tank from the housing by elevating the water tank above the water tank receiving platform such that the plurality of hook-shaped second connectors of the water tank disengage from corresponding hook-shaped first connectors of the interior sidewall and are slid out of the corresponding alignment grooves; and the water outlet valve is withdrawn from the water valve receptacle allowing the water tank to be removed laterally from the water tank receiving space of the housing;

removing the removable cover from the water tank;

filling the water tank with water;

then, connecting the filled water tank to the housing by simultaneously:

sliding the plurality of hook-shaped first connectors of the interior sidewall into corresponding alignment grooves of the water tank until the hook-shaped first connectors engage corresponding hook-shaped second connectors of the water tank;

seating the water tank in the water tank receiving space on the water tank receiving platform, such that the spacing wall provides support to the water tank;

engaging the plurality of engagement ribs with the water tank receiving platform; and inserting the water outlet valve into and through the water valve receptacle so that the valve actuator engages the water outlet valve.

18. A method for refilling a countertop ice making device located on a countertop underneath a cabinet of claim 17, wherein the provided removeable water tank includes a protective annular ring that is disposed around the water outlet valve.

19. A method for refilling a countertop ice making device located on a countertop underneath a cabinet of claim 17, wherein the provided ice making device further comprises an L-shaped drawer.

20. A method for refilling a countertop ice making device located on a countertop underneath a cabinet of claim 17, wherein the provided removeable water tank is translucent.

* * * * *